US007419937B2

(12) United States Patent
Rimmer et al.

(10) Patent No.: US 7,419,937 B2
(45) Date of Patent: Sep. 2, 2008

(54) METHOD FOR PROVIDING TREATMENT CHEMICALS IN A SUBTERRANEAN WELL

(75) Inventors: Brett Rimmer, Sugar Land, TX (US); Alan Saxon, York (GB); Francisco Fragachan, Barcelona (ES)

(73) Assignee: Schlumberger Technology Corporation, Sugar Land, TX (US)

( * ) Notice: Subject to any disclaimer, the term of this patent is extended or adjusted under 35 U.S.C. 154(b) by 331 days.

(21) Appl. No.: 10/707,534

(22) Filed: Dec. 19, 2003

(65) Prior Publication Data

US 2004/0138068 A1 Jul. 15, 2004

Related U.S. Application Data

(60) Provisional application No. 60/435,150, filed on Dec. 19, 2002.

(51) Int. Cl.
*C09K 8/528* (2006.01)
*C09K 8/536* (2006.01)

(52) U.S. Cl. ..... 507/90; 507/117; 507/128; 507/138; 507/219; 507/237; 507/238; 507/260; 507/261; 507/267; 166/117; 166/304

(58) Field of Classification Search ..... 166/310, 166/162; 507/128, 117, 219, 237, 90
See application file for complete search history.

(56) References Cited

U.S. PATENT DOCUMENTS 2,352,832 A * 7/1944 Gunderson ..... 166/268
2,531,829 A * 11/1950 Seymour ..... 507/261
2,723,233 A * 11/1955 Lytle ..... 507/244
2,728,400 A * 12/1955 Rohrback ..... 166/243
2,756,211 A * 7/1956 Jones ..... 507/244
2,760,584 A 8/1956 Rohrback ..... 166/243
2,801,697 A * 8/1957 Rohrback ..... 166/244.1
2,843,206 A * 7/1958 McNamara ..... 166/267
2,859,827 A * 11/1958 Elkins et al. ..... 166/165
2,889,276 A * 6/1959 Barrett et al. ..... 507/250
2,968,351 A * 1/1961 Jones ..... 166/162
3,020,961 A * 2/1962 Orr ..... 166/165
3,021,278 A * 2/1962 Caldwell et al. ..... 507/234
3,104,716 A * 9/1963 Burkhardt et al. ..... 166/165
3,347,797 A * 10/1967 Kuegemann et al. ..... 252/181
3,827,977 A 8/1974 Miles et al. ..... 252/8.55
4,602,683 A 7/1986 Meyers ..... 166/279
4,779,679 A 10/1988 Snavely, Jr. et al. ..... 166/279
4,787,455 A 11/1988 Snavely, Jr. et al. ..... 166/279
4,790,386 A * 12/1988 Johnson et al. ..... 166/310
4,846,279 A 7/1989 Bruce ..... 166/310

(Continued)

FOREIGN PATENT DOCUMENTS

WO 99/36668 7/1999

*Primary Examiner*—Randy Gulakowski
*Assistant Examiner*—John J Figueroa
(74) *Attorney, Agent, or Firm*—Thomas O. Mitchell; David Cate; Robin Nava

(57) ABSTRACT

A method of delivering chemicals such as scale inhibitor into a wellbore producing fluids includes providing the chemicals, in a slow-release form, in a container located in the path of the production fluids so that the production fluids pass through the container. Preferably, the container is suspended in the production tubing and periodically retrieved from the well to be refilled.

16 Claims, 3 Drawing Sheets

U.S. PATENT DOCUMENTS 5,141,655 A 8/1992 Hen ..... 252/8.552
5,403,493 A * 4/1995 Mouche et al. ..... 210/697
5,604,185 A 2/1997 Hen ..... 507/119
5,813,466 A 9/1998 Harris et al. ..... 166/300
5,893,416 A 4/1999 Read ..... 166/304
5,964,291 A 10/1999 Bourne et al. ..... 166/279
6,387,986 B1 * 5/2002 Moradi-Araghi et al. .... 523/211
6,655,475 B1 * 12/2003 Wald ..... 175/64
6,723,683 B2 * 4/2004 Crossman et al. ..... 507/111

* cited by examiner

METHOD FOR PROVIDING TREATMENT CHEMICALS IN A SUBTERRANEAN WELL

RELATED APPLICATION

This patent application claims the priority of provisional application 60/435,150, filed on Dec. 19, 2002.

TECHNICAL FIELD OF THE INVENTION

This invention relates to an apparatus and methods for providing treatment chemicals in a subterranean formation. More particularly, the invention relates to methods of ensuring permanent treatment of wells. Such treatments are particularly useful at inhibiting the formation of scales.

Concurrently with production fluids such as crude oil, dissolved salts are typically produced which form mineral deposits or scales such as barium sulfate, strontium sulfate, calcium sulfate and calcium carbonate. These mineral deposits tend to reduce the effective diameter of the production tubing, by plugging them or by damaging some valves or other subterranean equipment. Similar problems may occur in injection wells where the injected fluids are typically brines, for instance, when injected brines mix with the water phase of a produced fluid.

To alleviate the scale problems, various treatments have been developed that include for instance, injecting into the reservoir a solution comprising a scale inhibitor which is adsorbed onto the rock and later desorbed during fluid production. Different systems have been developed that provide a relatively slow release of the scale inhibitor. Reference is made for instance to U.S. Pat. Nos. 3,827,977, 4,602,683, 5,141,655 and 5,604,185.

However, most current scale inhibition treatments are only effective for a limited period. It is common to repeatedly treat the well every few months. Each treatment requires means—such as pumping equipment and/or coiled tubing injectors—for injecting the inhibitor solution and a preflush or afterflush treatment. Even though each cleaning job is relatively simple and constitutes a minimal cost for the oil industry, the repetition of the treatments month after month impedes the profitability of the well.

Another disadvantage of the conventional technologies is that the treatments are often administered or conducted by guesswork. Repeated analysis of the produced fluids is mostly impracticable and hence, would not necessarily provide good information as to the fluids present downhole.

Therefore, it would be desirable to provide less complex methods to treat wells. In particular, it would be advantageous to provide a longer term inhibition of scale formation and further provide better ways of assessing the effectiveness of the treatment.

SUMMARY OF THE INVENTION

In one embodiment, the invention relates to a method for treating a subterranean formation comprising providing a container located within the production tubing—or near the bottomhole extremity of the production tubing, said container filled with at least one chemical and comprising at least an opening.

The invention also relates to a method of replenishing the chemical(s) in the container, comprising fishing the container with a fishing tool connected to a slick line, a wireline or coiled tubing, refilling the container at the surface and replacing it downhole.

DETAILED DESCRIPTION OF THE PREFERRED EMBODIMENTS

In a preferred embodiment, the container consists of a meshed or meshlike basket through which the production fluids will flow. The mesh—or other apertures—is/are preferably of relatively high dimension so that the flow of production fluids is not significantly impeded.

The container is preferably suspended near the bottomhole extremity of the production tubing so that at least a large fraction of the production fluids is effectively treated before entering the production tubing.

Figure 1:
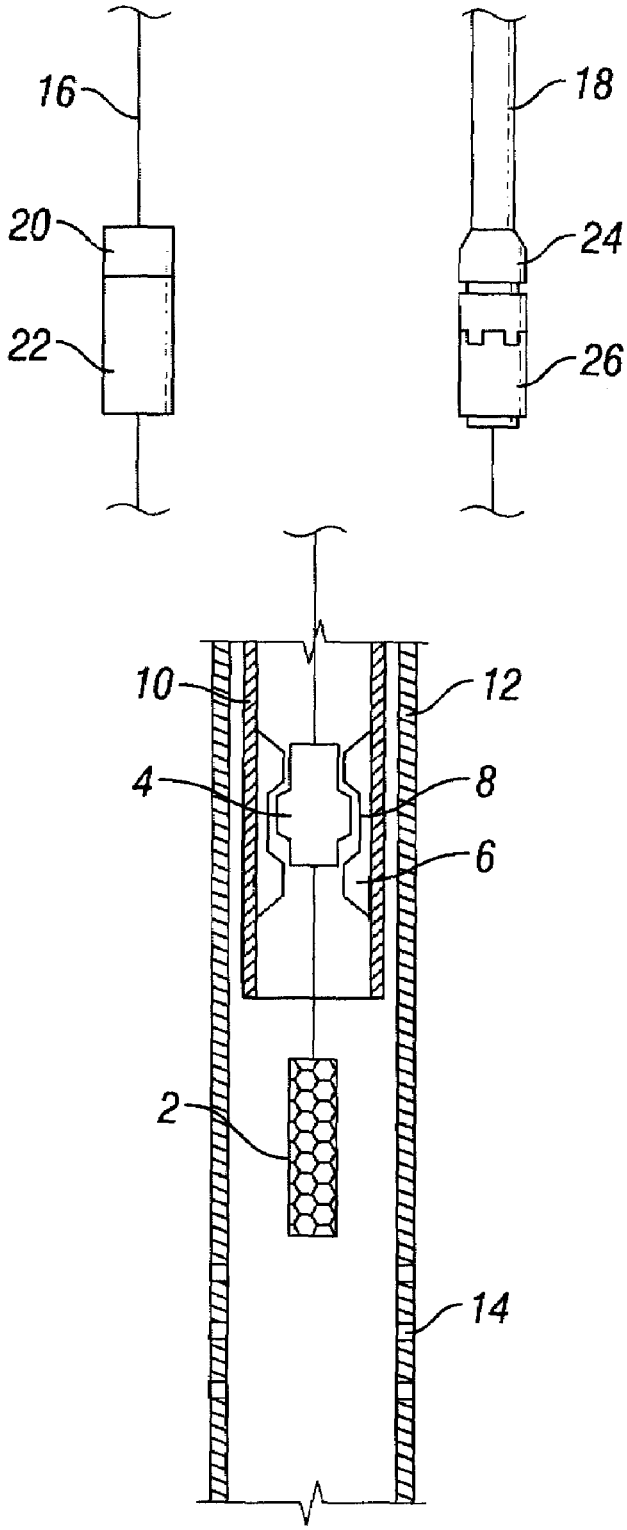
FIG. 1 shows a container suspended from a hanger with a nipple having a lock profile.

In one embodiment of the invention, as illustrated in FIG. 1, the container [2] is suspended from a hanger [4] seating in a lock profile [6] of a nipple [8] located within the tubing [10], near its downhole extremity. Advantageously, most tubing is already equipped with such a nipple. In FIG. 1, the well is shown having a casing [12], which is usually cemented, that ensures zonal isolation and the mechanical integrity of the well. The production fluids are displaced up to the surface through production tubing. In the pay zone, perforations [14] are provided for the formation fluids to enter the well. Similar configurations may be found with injection wells (even if, of course, the flow is from the surface to the subterranean formation). The hanger is preferably provided with a connection means that allows a secure connection for instance to a slick line or wireline [16] or coiled tubing [18] though a detent self-locking device, used for locating the basket in the wellbore and retrieving it either at periodical intervals or when surface analysis show an increase of the production of scales. The self-locking device is a slick line or wireline connector [20] and a slick line or wireline weak point [22] for a slick line or wireline, or a coiled tubing connector [24] and a coiled tubing disconnect [26] for coiled tubing. With the apparatus shown in FIG. 1, the basket may be set or retrieved on a slick line or wireline or with coiled tubing; it may be set only in the nipple where it was placed with coiled tubing.

Figure 2:
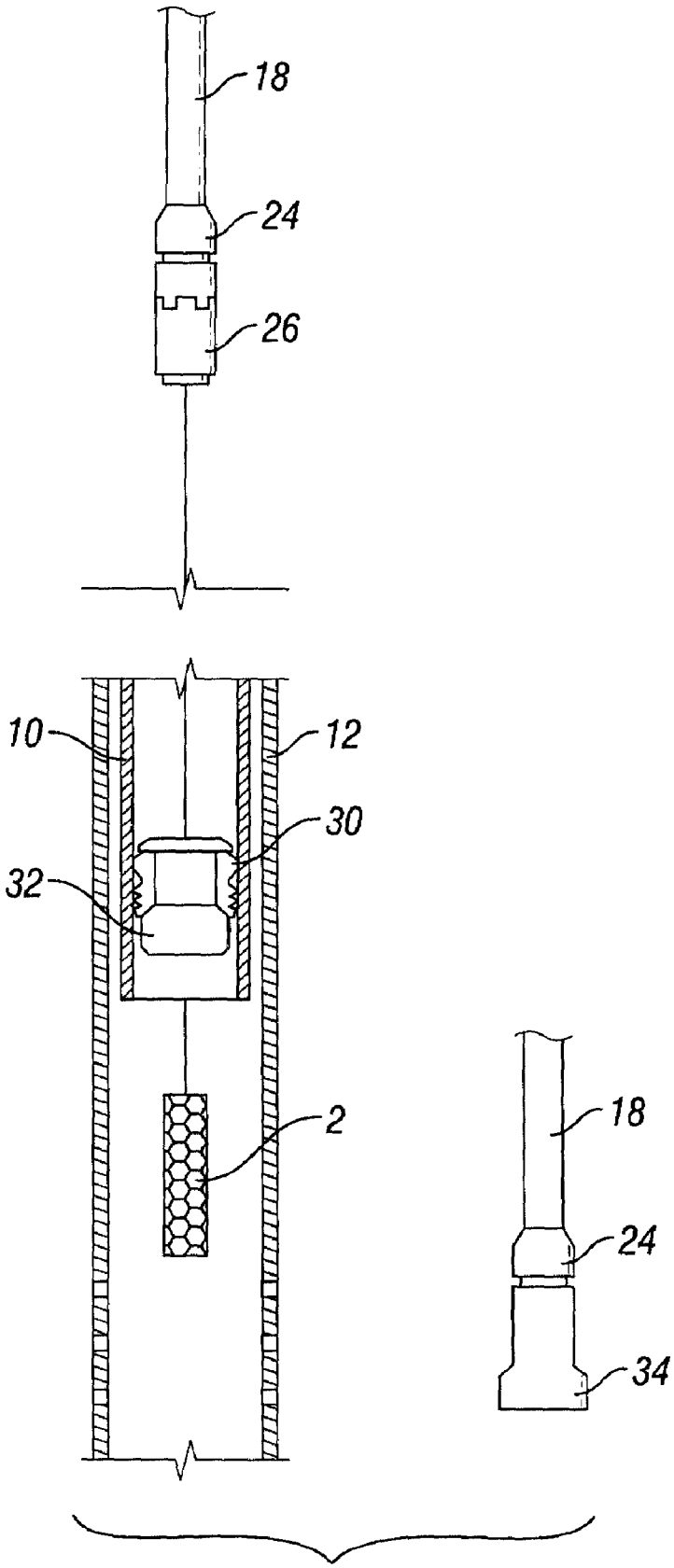
FIG. 2 shows a retrievable container suspended from an anchor.

According to another embodiment, as shown in FIG. 2, the tubing [10] is provided with an anchor catcher [30] and the container [2] is suspended from an anchor set [32] and retrieved when needed through the use of coiled tubing, wireline, slick line or similar equipment. With this design, the basket may be set at any point in the tubing. FIG. 2 shows this embodiment with coiled tubing; a coiled tubing retrieval tool [34] is used for retrieval with coiled tubing.

Figure 3:
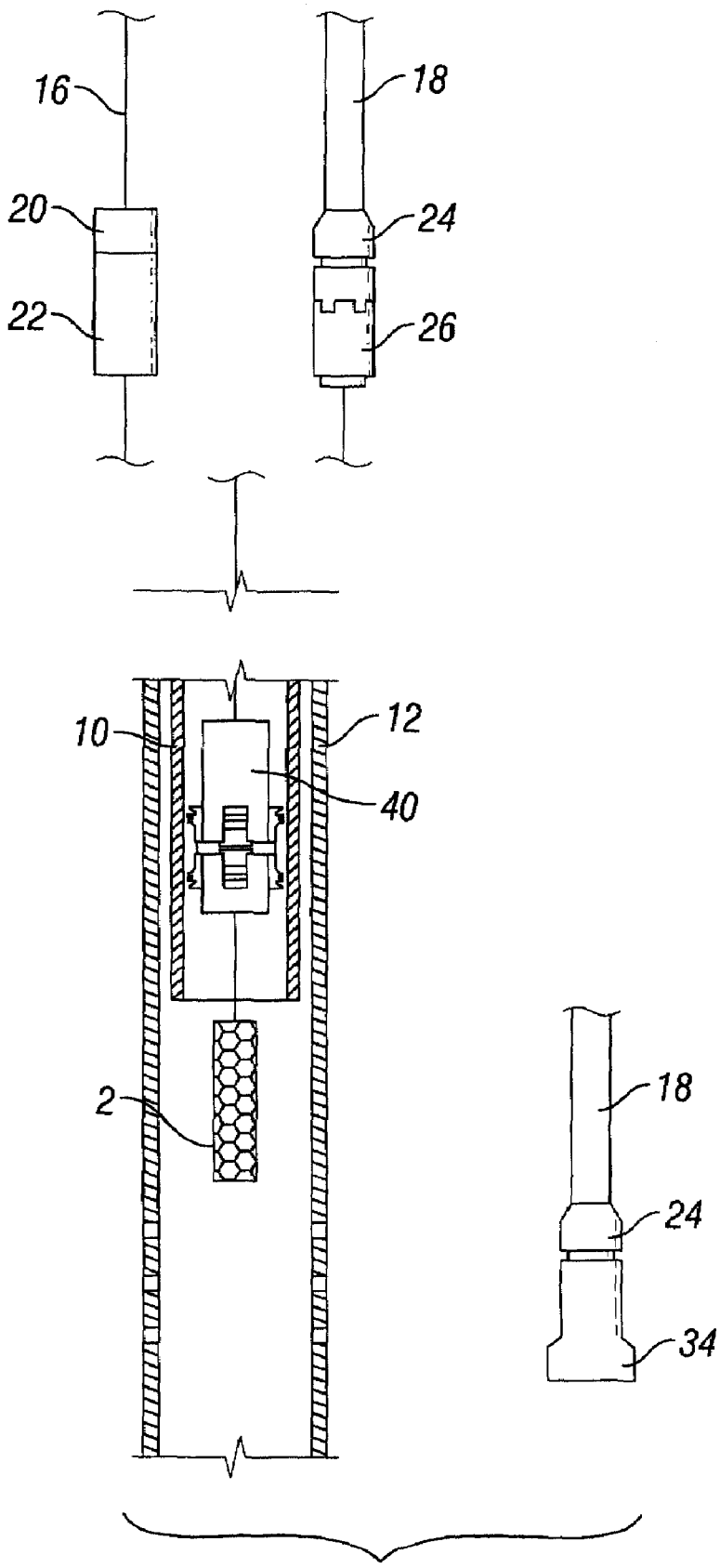
FIG. 3 shows a container suspended from a hydraulic wireline set with retractable jaws.

According to a third embodiment, as shown in FIG. 3, the container [2] is suspended from a hydraulic wireline set [40] comprising retractable jaws. This embodiment makes it possible to adjust the position of the basket at the lower extremity—or inside the tubing—to ensure a better treatment. With this design the basket may be set and retrieved with slick line, wireline or coiled tubing, and it may be set anywhere in the tubing.

According to a fourth embodiment, the container is permanently anchored at the end or within the production tubing and coiled tubing (or slickline or similar) is used to refill it. This embodiment is usually not preferred since it does not allow one to assess the release-rate of chemicals into the well and, therefore, the periodicity of the refill operation may not be accurate.

According to another embodiment, not shown, the container may be introduced into the well by pumping it into the hole (like a pig), and similarly pumping it out. In this latter case, the tubing should preferably be equipped with a latch or recess or equivalent mechanism to stop the container in the appropriate location.

The chemicals to be slowly released may be encapsulated within a polymeric enclosure. The enclosure may consist of any polymer that can degrade over a period of time to release said chemicals and will typically be chosen depending on the release rate desired. Degradation of the polymer can occur, for example, by hydrolysis, solvolysis, melting, or other mechanisms.

Preferred polymers are selected from the group consisting of homopolymers and copolymers of glycolate and lactate, polycarbonates, polyanhydrides, polyorthoesters, and polyphosphacenes. Most preferably, said polymer is poly(lactic acid-co-glycolic acid).

The encapsulation may be accomplished by known methods such as a double emulsion technique involving the evaporation of a secondary emulsion by freeze drying or another drying method.

The scale inhibitor may also be delivered in the form of porous ceramic particles such as the ones described in WO99/36668 hereby incorporated by reference. Another method for making porous particles suitable for introducing chemicals into a well is also known from U.S. Pat. No. 5,893,416 and U.S. Pat. No. 5,964,291 also incorporated by reference.

A large variety of scale inhibitors is available commercially. Most of the commercialized scale inhibitors contain several reactive groups (carboxylate and/or phosphonate) which are capable of interacting with polyvalent metal ions to prevent scale deposits. Examples of inhibitors include a polycarboxylate, (homo or copolymer of an ethylenically unsaturated acid monomer such as acrylic acid, methacrylic acid, maleic acid, itaconic acid, fumaric acid, mesoconic acid, citraconic acid and the like), monoesters of diacids with alkanols, e.g., having 1-8 carbon atoms, and mixtures thereof, and monomeric and polymeric phosphonates, e.g., aminomethylenephosphonates and homopolymers and copolymers of vinylphosphonate. Another class of inhibitors which may be used in practicing the method of this invention is organic phosphate esters such as phosphate esters of polyols and their salts containing one or more 2-hydroxyethyl groups, and hydroxylamine phosphate esters obtained by reacting polyphosphoric acid or phosphorus pentoxide with hydroxylamines such as diethanolamine or triethanolamine.

Though the invention is preferably used for delivering scale inhibitor, the same equipment—and method of replenishing it—can be used for other types of chemicals. For instance, several containers may be located near distinct perforation areas and a distinct chemical marker (for instance a dye) may be provided in each container. This provides an easy way to identify producing—and non-producing—areas. In this case, a string of containers may be used, all anchored to one single seat.

The invention claimed is:

1. A method of delivering a chemical into a wellbore comprising providing the chemical in a solid slow-release form, introducing the chemical in a meshed- or mesh-like re-usable basket container through which produced fluids can flow without being significantly impeded, and locating the container with the chemical in the wellbore, wherein said container in the wellbore is suspended in the path of the produced fluids, wherein said basket container is comprised of sides comprised of mesh and wherein said solid slow-release chemical is held in the basket container by the mesh.

2. The method of claim 1, wherein the container is placed in the wellbore by pumping it into the wellbore.

3. The method of claim 1, in which the producing fluids are flowing from the subterranean formation to the surface through production tubing and wherein the container is placed near the extremity of the production tubing.

4. The method of claim 1, wherein the container is suspended from a hanger located in the production tubing.

5. The method of claim 3, wherein the production tubing is provided with a nipple.

6. The method of claim 3, wherein the production tubing is provided with an anchoring means.

7. The method of claim 1, further comprising removing the container from the wellbore, refilling it and replacing the refilled container in the wellbore.

8. The method of claim 6, wherein the container is attached to a fishing tool connected to a wellbore tool selected from the group consisting of slick line, wireline and coiled tubing.

9. The method of claim 1, wherein said chemical is a scale inhibitor.

10. The method of claim 9, wherein said scale inhibitor is selected from the group consisting of a carboxylate, phosphonates and mixtures thereof.

11. The method of claim 9, wherein said scale inhibitor is an organic phosphate ester.

12. The method of claim 1, wherein said chemical is encapsulated.

13. The method of claim 12, wherein said chemical is encapsulated in a polymer selected from the group consisting of homopolymers and copolymers of glycolate and lactate, polycarbonates, polyanhydrides, polyorthoesters, and polyphosphacenes.

14. The method of claim 13, wherein said polymer is poly (lactic acid-co-glycolic acid).

15. The method of claim 1, wherein the container is refillable.

16. The method of claim 1, wherein the chemical is at least one of encapsulated in a polymer or provided in a porous ceramic particle.

* * * * *